United States Patent [19]

Stoll

[11] Patent Number: 4,919,267

[45] Date of Patent: Apr. 24, 1990

[54] NESTABLE AND STACKABLE TOTE CONTAINERS

[75] Inventor: Mark S. Stoll, Deephaven, Minn.

[73] Assignee: Liberty Diversified Industries, Minneapolis, Minn.

[21] Appl. No.: 219,258

[22] Filed: Jul. 15, 1988

[51] Int. Cl.[5] ..... B65D 21/04

[52] U.S. Cl. ..... 206/507; 229/915; 229/166

[58] Field of Search ..... 206/507; 229/166, 171, 229/52 B, 915, 919

[56] References Cited

U.S. PATENT DOCUMENTS

| | | | |
|---|---|---|---|
| 1,153,057 | 9/1915 | Garritson | 229/166 |
| 2,013,874 | 10/1935 | Whalley | 229/52 B |
| 2,373,730 | 4/1945 | Williamson | 229/171 |
| 2,702,155 | 2/1955 | Baumann | 229/52 B |
| 2,742,181 | 4/1956 | Jarund | 206/507 |
| 2,931,535 | 4/1960 | Lockwood | 206/507 |
| 2,954,914 | 10/1960 | Herlihy | 229/52 B |
| 2,964,211 | 12/1960 | Pfeffer | 206/507 |
| 3,270,913 | 9/1966 | Bridenstine | 206/507 |
| 3,939,981 | 2/1976 | King | 206/507 |
| 4,046,312 | 9/1977 | Krizan | 229/166 |
| 4,682,727 | 7/1987 | Stoll | 229/915 |

FOREIGN PATENT DOCUMENTS

| | | | |
|---|---|---|---|
| 672694 | 10/1963 | Canada | 206/507 |
| 1449002 | 7/1966 | France | 206/507 |

*Primary Examiner*—George E. Lowrance
*Attorney, Agent, or Firm*—Moore & Hansen

[57] ABSTRACT

Stackable and nestable tote containers folded to an upright configuration defining a generally tapered rectangular receptacle region from a flat blank of double faced corrugated plastic. The tote containers may be nested within one another in an aligned column, or may be selectively stacked on top of one another at an orientation of between 45 and 90 relative to one another, such that the receptacle region of the lower tote container is partially obstructed but may still be accessed. In one embodiment, a rectangular cross stacking tote container having a length greater than its width may be nested within a like tote container, or elevated to a position completely above the like tote container, rotated 90 in either direction such that apertures in the base and side wall panels are aligned with upwardly projecting exposed segments of the metal rim of the lower tote container, and lowered into a stacking engagement thereon. In a second embodiment, a generally square twist stacking tote container may be nested within a like container, or elevated to a position near the top of the like tote container, and rotated 45 in either direction such that apertures defined in the corners of the upright side walls receive and engage portions of the rim member which are exposed through handgrip openings in the side walls of the tote container.

13 Claims, 3 Drawing Sheets

NESTABLE AND STACKABLE TOTE CONTAINERS

BACKGROUND OF THE INVENTION

This invention relates generally to tote containers and cartons folded from a generally planar blank of sheet material and having a retaining rim, and particularly to an tote container design which permits an open-top tote container to be integrally locked and cross stacked on a like open-top tote container in a non-aligned vertical column.

A multiplicity of various tote containers, cartons, and boxes are known to the art, each having features making that container, box, or carton more suitable for particular applications.

In particular, a representative example of an open-top tote container folded from a blank of three-ply corrugated plastic sheet material and having a metal retaining rim is disclosed in U.S. Pat. No. 4,682,727.

In general, such tote containers are designed to be nested within one another, and therefore have angled or tapered side walls, and may include a stacking shoulders which prevent a container nested within a like container from becoming permanently wedged therein.

Another example of such an open-top tote container which may be selectively collapsed and which has a portion of the rim elevated to form handle grips is disclosed in the pending U.S. patent application Ser. No. 07/041,927.

In order to accommodate stacking such tote containers or cartons, various modifications have been incorporated to support and align a plurality of like tote containers in a vertical column, such as lid flaps, stacking tabs, or hand grips having corner supports and raised rims. Representative examples of these features may be seen in U.S. Pat. Nos. 4,709,852 and 4,119,265, and the pending U.S. patent application Ser. No. 6/911,993.

Such arrangements generally require the alignment of the tote containers when stacked in a vertical column, and thereby block or prevent items from being added to or removed from the receptacle regions of the lower tote containers. Further, stacking such tote containers require that some support apparatus be positioned or engaged to hold the top container, such as folding down the lid flaps or adding a rack or tray support.

BRIEF SUMMARY OF THE INVENTION

It is therefore one object of this invention to design a tote container which may be nested within like tote containers, and be quickly elevated from the nested position within a like container to a stacked position disposed substantially above that like container.

It is another object of this invention to design the above tote container such that a column of stacked containers can be formed while still permitting the receptacle regions of one or more of the lower containers to be accessed.

It is yet another object of this invention to design the above tote container such that this nesting to stacking conversion can be facilitated without any modification of the lower tote container, without regard to or altering of the number of nested containers, and without the person having to remove their grip from the container being stacked.

It is a related object of this invention to design the above tote container such that a plurality of similar containers can be alternatingly stacked or nested, and the order of stacked or nested containers may be frequently and selectively altered without regard to the condition of the underlying or overlying containers.

It is a distinct object of this invention to design the above tote container so as to have increased structural stability in the stacked configuration, and such that the stacking facility does not impede the normal use of the tote containers.

Briefly described, the stackable and nestable tote containers of this invention may each be folded to an upright configuration defining a generally tapered rectangular receptacle region from a flat blank of double faced corrugated plastic. The tote containers may be nested within one another in an aligned column, or may be selectively stacked on top of one another at an orientation of between 45° and 90° relative to one another, such that the receptacle region of the lower tote container is partially obstructed but may still be accessed.

In one embodiment, a rectangular cross stacking tote container having a length greater than its width may be nested within a like tote container, or elevated to a position completely above the like tote container, rotated 90° in either direction such that apertures in the base and side wall panels are aligned with upwardly projecting exposed segments of the metal rim of the lower tote container, and lowered into a stacking engagement thereon.

In a second embodiment, a generally square twist stacking tote container may be nested within a like container, or elevated to a position near the top of the like tote container, and rotated 45 in either direction such that apertures defined in the corners of the upright side walls receive and engage portions of the rim member which are exposed through handgrip openings in the side walls of the tote container.

DESCRIPTION OF THE PREFERRED EMBODIMENT

Figure 1:
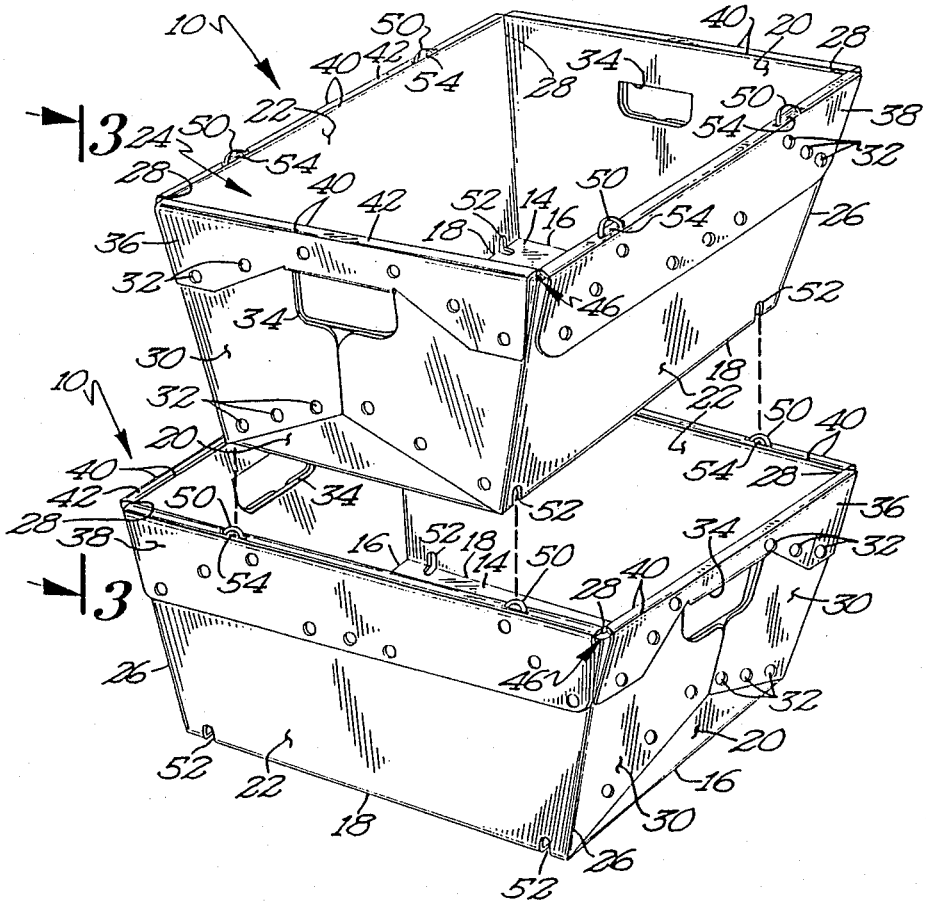
FIG. 1 is a perspective view of the cross stacking embodiment of the tote container of this invention showing a tote container in the cross stacked configuration on top of a like tote container.

The nestable and stackable tote container of this invention is shown in FIGS. 1–13 and referenced generally therein by the numeral 10.

One embodiment of the nestable and stackable tote container 10 of this invention termed the cross stacking tote container is shown in FIGS. 1–7.

Referring generally to FIGS. 1–7, it may be seen that each cross stacking tote 10 is formed from a generally planar blank 12 of three ply corrugated plastic sheet material such as polyethylene, the corrugated plastic sheet material having two generally planar parallel plies 12*a*, 12*b* spaced apart a distance, with a convoluted intermediate ply or a multiplicity of parallel cross braces 12*c* extending between the planar plies and forming a generally parallel grain G extending longitudinally or transversely across the blank 12.

Each tote container 10 comprises a generally planar base panel 14 having a first pair of opposing end edges 16 and a second pair of opposing side edges 18 defined in the blank 12 by scored fold lines. The end edges 16 and side edges 18 define a generally rectangular peripheral edge extending around the bottom of the tote container 10.

Hingedly connected to the the base panel 14 along the scored end fold lines 16 are a pair of opposing end wall panels 20, and hingedly connected to the the base panel 14 along the scored side fold lines 18 are a pair of opposing side wall panels 22. The opposing end wall panels 20 and opposing side wall panels 22 may be folded upwardly across the scored fold lines 16, 18 to a generally upright tote configuration such that the base panel 14, end wall panels 20, and side wall panels 22 define an open-top receptacle region 24 which may receive and support articles (not shown). The base panel 14 and opposing open top of the receptacle region 24 generally define a top and a bottom of the tote container 10 when the tote container 10 is oriented in an upright configuration and position as shown in FIGS. 1 and 5.

Figure 5:
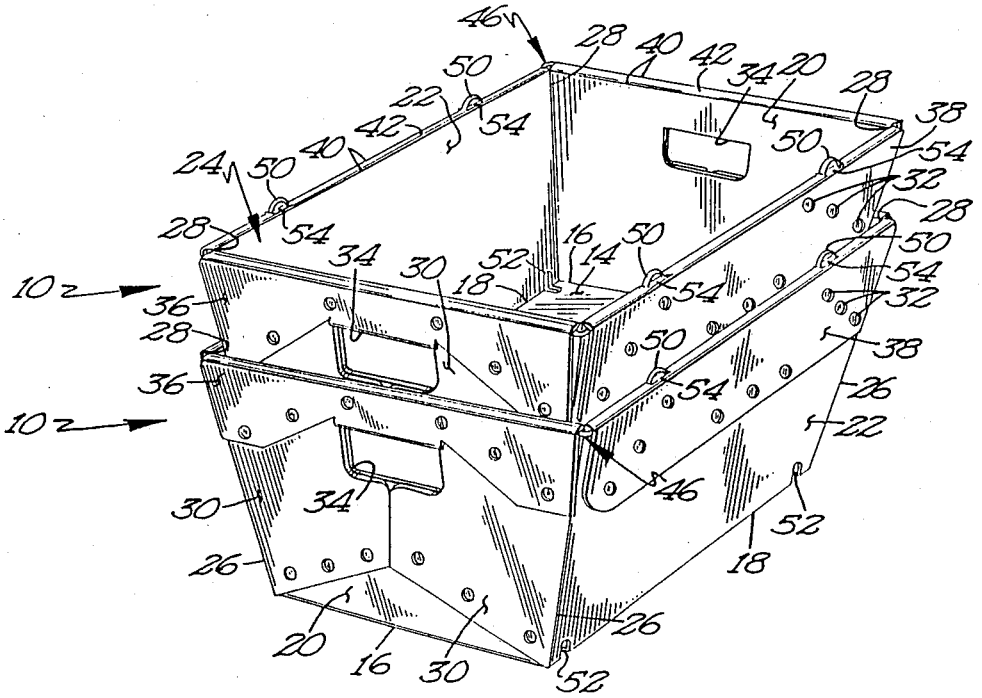
FIG. 5 is a perspective view showing a cross stacking tote container nested within a like cross stacking tote container.

Each end wall panel 20 and side wall panel 22 has a pair of tapered edges 26 which are oriented in a generally upright direction when the tote container 10 is folded to the upright configuration as shown in FIGS. 1 and 5. Each upright edge 26 of the end wall panels 20 or side wall panels 22 is aligned with and adjacent to an upright edge 26 of one of the adjacent and perpendicular side wall panels 22 or end wall panels 20, respectively, to form four generally upright corners 28 of the receptacle region 24.

Extending from and hingedly connected along scored fold lines to each of the edges 26 of the side wall panels 22 is an end foldover panel 30, a pair of the end wall panels 30 each being folded inwardly across each end of the tote container 10 and into close confronting contact with the end wall panels 20 and fastened thereto using a plurality of sonic welds 32 or other suitable fastening means. Each end foldover panel 30 defines one half of a handgrip opening 34, positioned so as to align with the half of a handgrip opening 30 on the adjacent end foldover panel 30 when the pair of end foldover panels 30 are folded together as shown in FIGS. 1 and 5.

Figure 2:
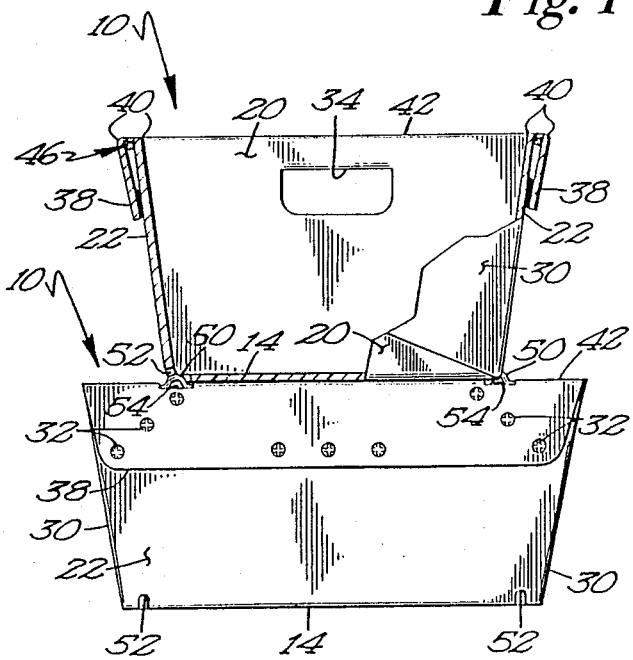
FIG. 2 is a partially cut away view of the stacked cross stacking tote containers of FIG. 1, taken along line 2—2 of FIG. 1.
Figure 3:
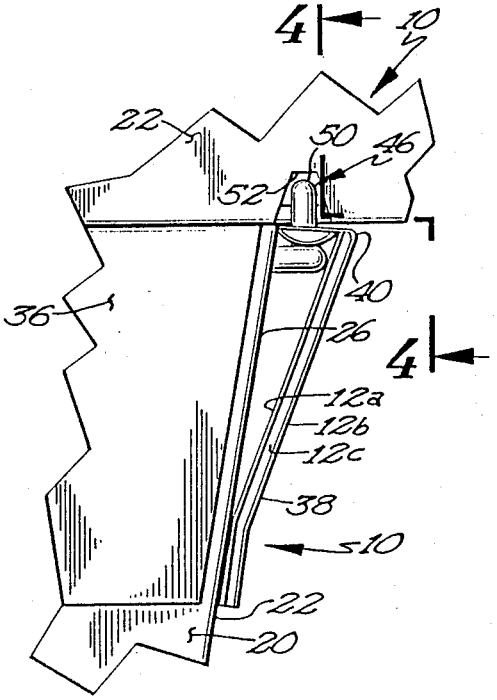
FIG. 3 is an enlarged side elevation view showing the stacked cross stacking tote containers of FIG. 1 taken from line 3—3 of FIG. 1.
Figure 6:
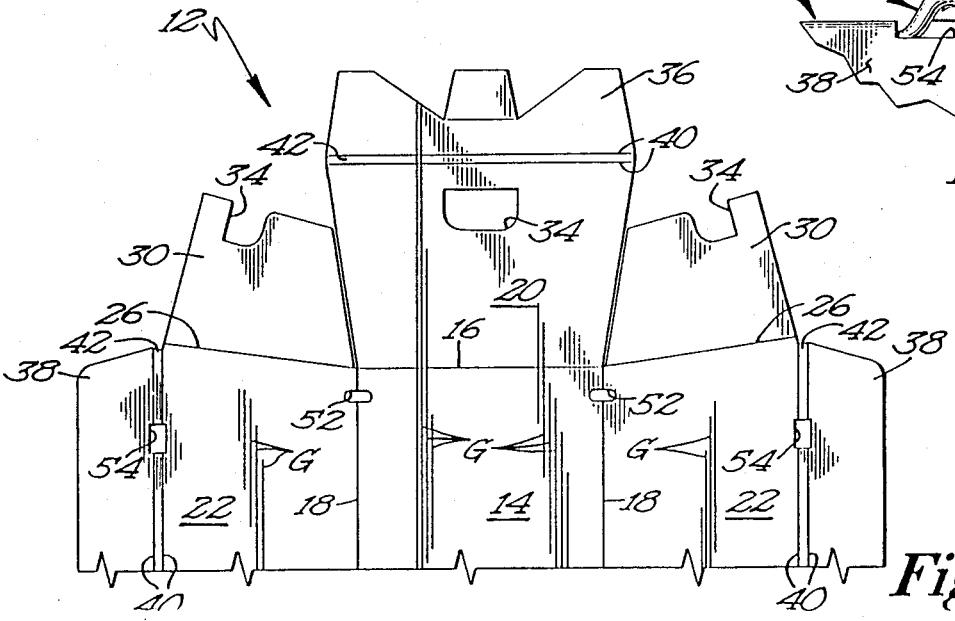
FIG. 6 is a top plan view of a segment of a blank used to form the cross stacking tote container of FIG. 1.

Referring to FIGS. 5 and 6, it may be seen that extending from the top edge of each end wall panel 20 and side wall panel 22 is an end flap 36 or side flap 38 hingedly connected to the corresponding end wall panel 20 or side wall panel 22, respectively, along double scored fold lines 40. As shown in FIGS. 1–3, it may be seen that the side flaps 38 and end flaps 36 are folded downwardly across the double scored fold lines 40 into close confronting contact with the corresponding side wall panels 22 and end foldover panels 30 and are fastened thereto using sonic welds 32. The portion of each of the end flaps 36 and side flaps 38 between the double score lines 40 form a generally horizontal top stacking edge 42 when the end flaps 36 and side flaps 38 are folded downwardly. In doing so, the space between the side wall panels 22 and side flaps 38, or between the end foldover panels 30 and end flaps 36, forms a rim retaining space 44 as shown particularly in FIG. 3 and the retaining rim member 46 is thereby substantially enclosed.

Figure 4:
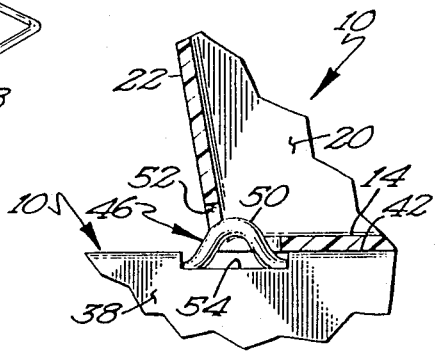
FIG. 4 is an enlarged partial cross section view of the exposed segment and stacking aperture rim member of the cross stacking tote container embodiment taken from line 4—4 in FIG. 3.

A generally rectangular rim 46 constructed from a round metal rod having a pair of ends 48 which are folded into close abutting contact with the retaining rim 46 traversing a substantially continuous path to form a rectangular hoop as shown in FIG. 4 may be received within the rim retaining space 44 and thereby substantially surround or circumscribe or extend peripherally around the open top of the receptacle region 24. It is anticipated that in various embodiments of the tote container 10, portions of the retaining rim 46 along the side wall panels 22 or end wall panels 20, or at the corners 28 of the receptacle region 24, may extend inwardly into the interior regions of the receptacle region 24. The retaining rim 46 is generally attached to the tote container 10 by placing or inserting the partially folded blank 14 downwardly through the retaining rim 46 until the retaining rim 46 is positioned slightly below the top edges of the side wall panels 22 and end wall panels 20 as defined by the scored fold lines 40, ad then folding the side flaps 38 and end flaps 36 outwardly and downwardly over the retaining rim 46 and then securing the flaps 36, 38.

Figure 7:
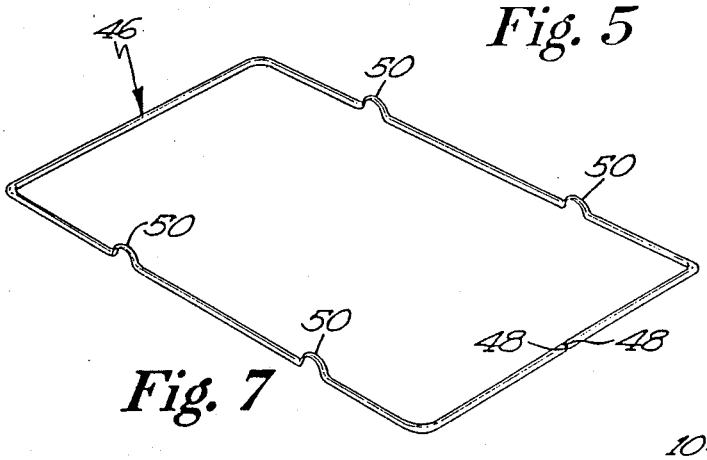
FIG. 7 is a perspective view of the rim member of the cross stacking tote container embodiment.

Referring to FIG. 7, it may be seen that the the retaining rim 46 defines four upward projecting segments 50 deformed from the surrounding sections of the retaining rim 46, two projecting segments 50 being positioned along each side of the retaining rim 46 an equal distance from each end of the retaining rim 46 and aligned with a pair of opposing projecting segments 50. Each projecting segment 50 has a length extending generally parallel with the section of retaining rim 46 from which the projecting segment 50 is deformed, with the distance between the centers of the projecting segments 50 being preferably equal to the width of the bottom of the tote container 10 corresponding to the width of the base panel 14 measured between the edges 18 thereof. In some applications, it may be suitable to position one exposed projecting segment 50 along each side of the tote container 10, preferably in a diagonally opposing arrangement such that one projecting segment 50 is located closer to one of the opposing ends of the tote container 10 than the other projecting segment 50.

Referring to FIGS. 1 and 6, it may be seen that the base panel 14 and side wall panels 22 define four oblong stacking apertures 52 each having a length generally greater than the length of the projecting segments 50 of the retaining rim 46 and a width generally greater than the diameter of the retaining rim 46 extending completely through the base panel 14 and side wall panels 22 and extending generally perpendicularly across the scored fold lines 18. The stacking apertures 5 along each side of the tote container 10 are spaced apart a distance preferably equal to the distance between two aligned and opposing projecting segments 50 across the width of the retaining rim 46 and top of the receptacle region 24, with the distance between the centers of each opposing and aligned stacking aperture 52 being on opposing fold lines 18 adjoining the base panel 14 and spaced generally equal to the distance between either of the two projecting segments 50 positioned on the sides of the retaining rim 46. With the base panel 14 having a width measured between the side wall panels 22 and a length measured between the end wall panels 20, two of the stacking apertures 52 are thus located along each side wall panel 22 and spaced apart a distance substantially equal to the width of the base panel 14, with each stacking aperture 52 also being spaced apart from a stacking aperture 52 along the opposing side wall panel 22 a distance substantially equal to the width of the base wall panel 14 such that the stacking apertures 52 form the vertices of a square.

Four top apertures 54 positioned along the horizontal top stacking edges 42 defined by the double scored fold lines 40 and aligned with the projecting segments 50 of the retaining rim 46 permit the projecting segments 50 of the retaining rim 46 to extend upwardly therethrough to further hold the retaining rim 46 in place and thereby define four exposed regions of the retaining rim projecting above the top of the stacking edges 42 and the open top of the receptacle region 24 of the tote container 10. As such, the exposed regions of the retaining rim 46 comprising the projecting segments 50 of a like tote container 10 may be aligned vertically under the oblong apertures 52 of a tote container 10 when the tote container 10 is positioned above the like tote container 10 and rotated one quarter turn or 90 relative to the like tote container 10.

Consequently, in operation, the cross stacking tote container 10 may be selectively nested within a like cross stacking tote container 10 with the upright corners 28 of the tote container 10 being generally aligned with the upright corners 28 of the like tote container 10 as shown in FIG. 5. The tote container 10 may also be selectively stacked on a like tote container 10 and thereby disposed partially over the receptacle region 24 of the like tote container 10 by lifting the upper tote container 10 from the nested position within the like tote container 10 as shown in FIG. 5 and rotating the upper tote container 10 one quarter turn so that the upright corners 28 of the upper tote container 10 are no longer aligned with the upright corners 28 of the like tote container and the projecting segments 50 of the retaining rim 46 which are exposed through the horizontal top stacking edge 42 of the lower tote container 10 may be removably received and engaged within the oblong apertures 52 of the tote container 10 as shown in FIGS. 1 and 4 to form a vertical column of stacked tote containers 10. The base panel 14 of the tote container 10 thereby partially obstructs the open top of the receptacle region 24 of the like tote container 10, but the receptacle region 24 of the like tote container 10 may still be accessed by a user without removing the tote container 10 from the stacked position by reaching and inserting or removing articles (not shown) between the side wall panels 22 of the tote container 10 and the end wall panels 20 of the like tote container 10 beneath, as shown in FIGS. 1 and 2.

It is anticipated that several like tote containers 10 may be alternately stacked or nested in a generally vertical column, and any one of the stacked or nested tote containers 10 may be selectively moved between the stacked and nested positions without regard to the relative configuration of the tote containers 10 positioned above or below the particular tote container 10, as long as the combined weight of the articles in the upper tote containers 10 permits the tote containers 10 positioned above the tote container 10 and the tote container 10 being reoriented to be lifted above the tote container 10 lying beneath.

Another embodiment of the nestable and stackable tote container 10 of this invention termed the twist stacking tote container 60 is shown in FIGS. 7–12.

Referring generally to FIGS. 7–13, the twist stacking tote container 60 comprises a plurality of generally upright side or end wall panels 62 and a base panel 64, each of the side wall panels 62 having substantially the same size and shape. It is anticipated that the base panel 64 may be triangular, square, hexagonal, octagonal, or any other suitable geometric form with a suitable number of side wall panels 62, although the square configuration having four side wall panels 62 is preferred.

Each twist stacking tote container 60 is constructed and assembled in substantially the same manner as the cross stacking tote container 10 discussed above, utilizing a generally rectangular retaining rim member 66, wall flaps 68 which are each hingedly connected to one of the side wall panels 62 along doubled scored fold lines 70 and folded downwardly either inwardly or outwardly into close parallel and confronting contact with the corresponding side or end wall panel 62 to substantially enclose and attach the retaining rim member 66 to the tote container 60, and first and second handgrip openings 72 defined by the side wall panels 62 and side flaps 68 respectively which permit segments of the retaining rim 66 to be exposed therethrough and used as handles. The handgrip openings 72 are generally symmetrical in shape and centered along the top edge of each wall panel 62.

Figure 8:
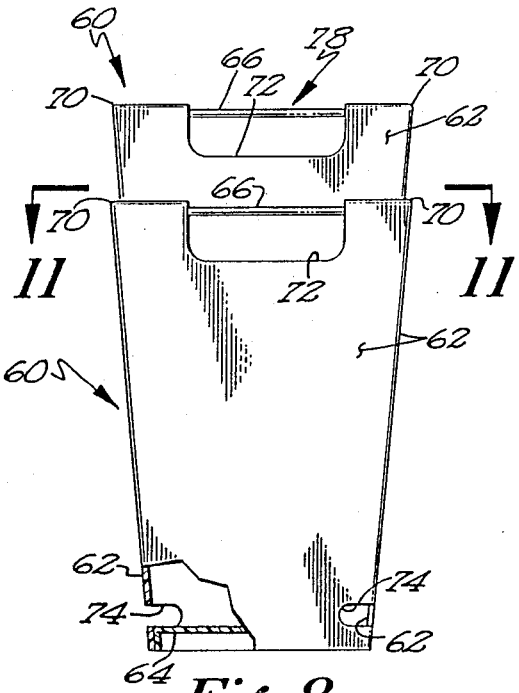
FIG. 8 is a side elevation view showing a twist stacking embodiment of the tote container tote container of this invention nested within a like twist stacking tote container.
Figure 10:
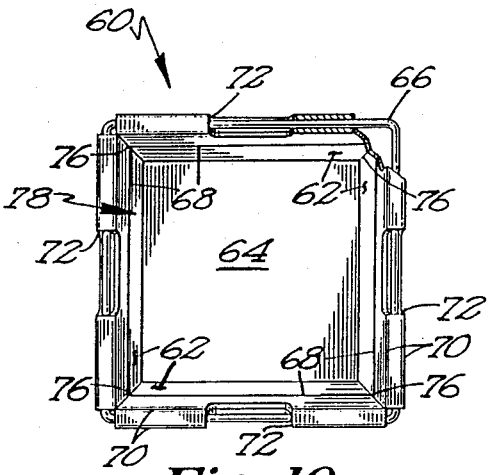
FIG. 10 is a partially cut away top view of the twist stacking tote container of FIG. 7.

In the case of the twist stacking tote container 60 as shown in FIGS. 8 and 10, the generally oblong stacking apertures 74 are each defined by two adjoining side and end wall panels 62 and extend across the hinged scored fold line or conversely any space between the side and end wall panels 62 forming the generally upright corners 76 of the open top receptacle region 78 of the twist stacking tote container 60. As such, the base panel 64 and base wall panels 62 defining the open top receptacle region 78 of each twist stacking tote container 60 further define a top and a bottom of the tote container 60.

Figure 9:
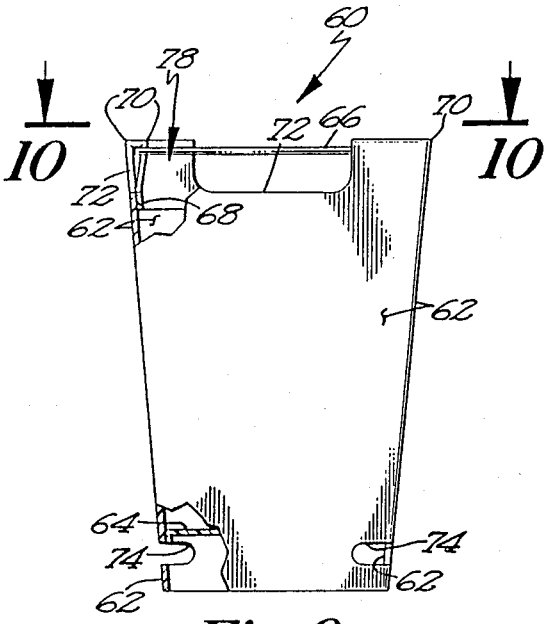
FIG. 9 is a partially cut away side plan view showing an alternate embodiment of one of the twist stacking tote containers of this invention having the staking apertures beneath the base panel.

As shown in FIG. 8, the oblong stacking apertures 74 are situated proximate to the bottom of the tote container 60 or receptacle region 78 but above the base panel 64, although it is anticipated that the stacking apertures 74 of twist stacking tote container 60 can be positioned below the base panel 64 in some applications as shown in FIG. 9, particularly where the tote container 60 is constructed to be water-tight, or to provide additional support for several stacked tote containers 60.

Figure 12:
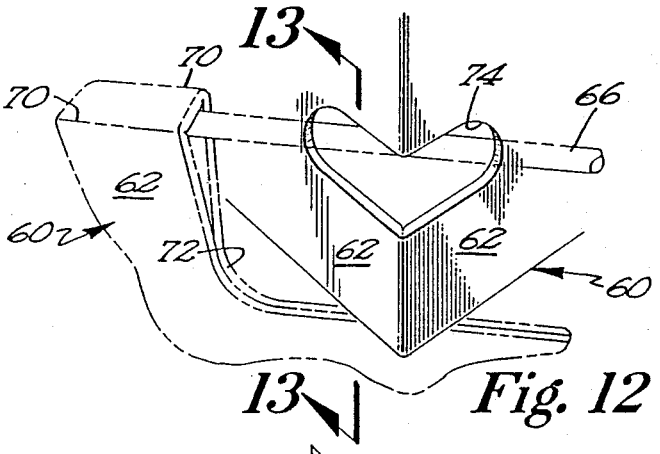
FIG. 12 is an enlarged perspective view of the twist stacking tote containers of FIG. 11 with the top tote container elevated and twisted into engagement with the tote container below.
Figure 11:
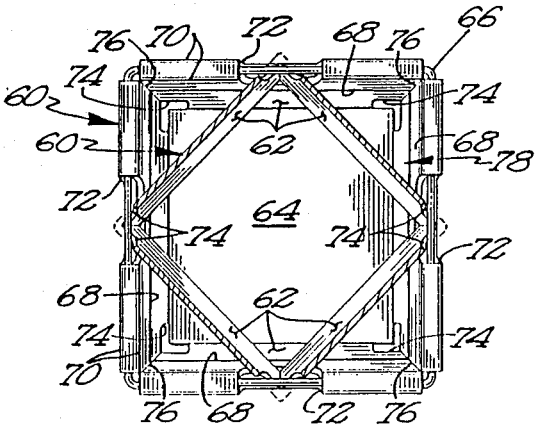
FIG. 11 is a top view of the twist stacking tote container of FIG. 7 taken from line 10—10 of FIG. 9 showing a like tote container stacked thereon in cross section.
Figure 13:
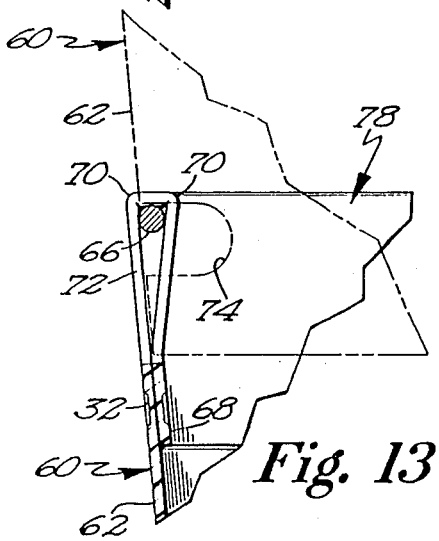
FIG. 13 is a partial cross section view of a segment of an alternate embodiment of the twist stacking tote container taken through line 13—13 of FIG. 12.

In operation, the twist stacking tote containers 60 may be selectively nested within a like twist stacking tote container 60 with the upright corners 76 of the tote container 60 being generally aligned with the upright corners 76 of the like tote container 60 as shown in FIG. 7. The tote container 60 may also be selectively stacked on a like tote container 60 and thereby disposed partially over the receptacle region 78 of the like tote container 60 by lifting the upper tote container 60 from the nested position within the like tote container 60 as shown in FIG. 7 and rotating the upper tote container 60 one eighth turn so that the upright corners 76 of the upper tote container 60 are no longer aligned with the upright corners 76 of the like tote container 60 and the segments of the retaining rim member 66 which are exposed through the handgrip openings 72 of the lower tote container 60 may be removably received and engaged within the oblong apertures 74 of the tote container 60 as shown in FIGS. 11–13 to form a vertical column of stacked tote containers 60. The base panel 64 of the tote container 60 thereby partially obstructs the open top of the receptacle region 78 of the like tote container 60 beneath, but the receptacle region 78 of the like tote container 60 may still be accessed by a user without removing the tote container 60 from the stacked and engaged position by reaching and inserting or removing articles (not shown) between the side wall panels 62 of the tote container 60 and the upright corners 76 of the like tote container 60 beneath, as may be seen from FIG. 11.

It is anticipated that several like tote containers 60 may be alternately stacked or nested in a generally vertical column, with any one of the stacked or nested tote containers 60 being selectively moved between the stacked and nested positions without regard to the relative configuration of the tote containers 60 positioned above or below the particular tote container 60, as long as the combined weight of the articles in the upper tote containers 60 permits the tote containers 60 positioned above the tote container 60 and the tote container 60 being reoriented to be lifted sufficiently high enough such that the exposed segments of the retaining rim 66 of the lower tote container 60 can be engaged in the apertures 74 of the tote container 60 being reoriented.

While the preferred embodiments of the above stackable and nestable tote containers 10 has been described in detail with reference to he attached drawing figures, it is understood that various changes and adaptations may be made in the stackable and nestable tote containers without departing from the spirit and scope of the appended claims.

What is claimed is:

1. A tote container which may be selectively nested or stacked in a vertical column with a like tote container, said tote container comprising:

a base panel having a first pair and a second pair of opposing edges and a length and a width, said length being greater than said width;

a pair of end wall panels, each said end wall panel extending generally upwardly from and being connected to one of said first pair of opposing edges of said base panel;

a pair of side wall panels, each said side wall panel extending generally upwardly from and being connected to one of said second pair of opposing edges of said base panel, each said side wall panel generally adjoining at least one of said end wall panels and being oriented generally perpendicular thereto such that said base panel, said side wall panels, and said end wall panels define a receptacle region having an open top and a bottom and a plurality of generally upright corners, said side wall panels and said end wall panels being generally outwardly tapered from said bottom of said receptacle region to said open top of said receptacle region such that the tote container may be nested within the like tote container and alternately the like tote container may be nested within the tote container; and a retaining rim member, said retaining rim member being connected to said end wall panels and said side wall panels and extending in a generally continuous path peripherally around the open top of the receptacle region, said retaining rim member defining a plurality of segments, said segments being exposed and extending upwardly and being oriented in a first direction, with at least one of said base panel or said side wall panels or said end wall panels of the tote container defining a plurality of stacking apertures extending at least partially therethrough and positioned proximate to the bottom of the receptacle region and oriented in a second direction generally perpendicular to said first direction in which said segments are oriented, whereby the tote container may be selectively nested within the like tote container with the generally upright corners of the tote container aligned with the generally upright corners of the like tote container, and whereby the tote container may be lifted from the nested position and rotated approximately 90° such that the length of the base panel of the tote container is generally perpendicular to the length of the base panel of the like tote container, the tote container thereby being selectively stacked in a stacked position on the like tote container and disposed over the receptacle region of the like tote container with the segments of the retaining rim member of the like tote container which are exposed removably received and engaged within the stacking apertures of the tote container, such that the base panel of the tote container partially obstructs the open top of the like tote container and the receptacle region of the like tote container may be accessed without removing the tote container from the stacked position.

2. The tote container of claim 1 wherein each of the side wall panels has a top edge and each of the end wall panels has a top edge, said tote container further comprising:

a plurality of end foldover panels, each said end foldover panel extending from and hingedly connected to one of the side wall panels, said end foldover panels being folded inwardly generally perpendicular to the corresponding side wall panel and into close confronting contact with the adjoining end wall panel and being fastened thereto;

a pair of side flaps, each said side flap extending from and hingedly connected to the top edge of one of the side wall panels along scored fold lines, said side flaps being folded downwardly across said fold lines into close confronting contact with the corresponding side wall panel and fastened thereto, the retaining rim member being received between each of said side flaps and the corresponding side wall panel; and a pair of end flaps, each said end flap extending from and hingedly connected to the top edge of one of the end wall panels along fold lines, said end flaps being folded downwardly across said fold lines into close confronting contact with the adjoining end foldover panel and fastened thereto, the retaining rim member being received between each of said end flaps and the corresponding end foldover panel.

3. The tote container of claim 2 wherein each of the side flaps and the corresponding side wall panel define at least one aperture extending therethrough, and wherein each of the exposed segments of the retaining rim member project generally upward relative to at least one remaining section of the retaining rim member proximate to each of the exposed segments, the exposed segments projecting through said apertures defined by the side flaps and the side wall panels.

4. The tote container of claim 3 wherein number of the apertures defined by the side flaps and the side wall panels is four, and the number of upwardly projecting exposed segments of the retaining rim member is four.

5. The tote container of claim 1 wherein the base panel and the side and end wall panels are constructed from a double faced corrugated polyethylene.

6. The tote container of claim 1 wherein each of the stacking apertures are defined by the base panel and an adjacent portion of one of the side wall panels.

7. The tote container of claim 6 wherein the base panel of the tote container has a width, and wherein two of the stacking apertures of the tote container are located along each side wall panel of the tote container, the stacking apertures located along each side wall panel being spaced apart a distance substantially equal to the width of the base panel, and each stacking aperture being spaced apart from one of the stacking apertures on the opposing side wall panel a distance substantially equal to the width of the base wall panel, such that the stacking apertures generally form the vertices of a square.

8. The tote container of claim 1 wherein the retaining rim member is generally rectangular and has a pair of sides and a width measured therebetween and a pair of ends and a length measured therebetween, each of the exposed segments of the retaining rim member projecting generally upward relative to at least one remaining section of the retaining rim member proximate to each of the exposed segments, two of the projecting segments being located along each side of the retaining rim member and being spaced apart a distance substantially equal to the width of the retaining rim member, and each projecting segment being spaced apart from one of the projecting segments on the opposing side of the retaining rim member a distance substantially equal to the width of the retaining rim member, such that the projecting segments generally form the vertices of a square.

9. A tote container which may be selectively nested or stacked in a vertical column with a like tote container, said tote container comprising:

a base panel having a first pair of opposing edges and a second pair of opposing edges, said first opposing edges each having a length and said second opposing edges each having a length, said length of said first opposing edges being approximately equal to said length of said second opposing edges;

a pair of end wall panels, each said end wall panel extending generally upwardly from and being connected to one of said first pair of opposing edges of said base panel;

a pair of side wall panels, each said side wall panel extending generally upwardly from and being connected to one of said second pair of opposing edges of said base panel, each said side wall panel generally adjoining at least one of said end wall panels and being oriented generally perpendicular thereto such that said base panel, said side wall panels, and said end wall panels define a receptacle region having an open top and a bottom and a plurality of generally upright corners, said side wall panels and said end wall panels being generally outwardly tapered from said bottom of said receptacle region to said open top of said receptacle region such that the tote container may be nested within the like tote container and alternately the like tote container may be nested within the tote container, said side wall panels and said end wall panels each having a top edge and each defining a first handgrip opening generally centered along said top edge; and a retaining rim member, said retaining rim member being connected to said end wall panels and said side wall panels and extending in a generally continuous path peripherally around the open top of the receptacle region, a plurality of segments of said retaining rim member being exposed through and along at least a portion of each said first handgrip opening, with each of said side wall panels and said adjoining end wall panel defining a stacking aperture extending at least partially therethrough at each of the generally upright corners and positioned proximate to the bottom of the receptacle region and generally equidistant to the base panel, whereby the tote container may be selectively nested within the like tote container with the upright corners of the tote container generally aligned with the upright corners of the like tote container, and whereby the tote container nested in the like tote container may be lifted upwardly until the stacking apertures are level with the segments of the retaining rim member which are exposed through the first handgrip openings of the like tote container and the tote container may be rotated approximately 45° such that the exposed segments of the retaining rim member of the like tote container are each received and engaged within one of the stacking apertures of the tote container, and thereby selectively stacked in a stacked position on the like tote container and disposed over the receptacle region of the like tote container to form a vertical column such that the base panel of the tote container partially obstructs the open-top of the like tote container and the receptacle region of the like tote container may be accessed without removing the tote container from the stacked position.

10. The tote container of claim 9 wherein the stacking apertures are each positioned above the base panel.

11. The tote container of claim 9 wherein the stacking apertures are each positioned below the base panel.

12. The tote container of claim 9 further comprising:

a plurality of wall flaps, each said wall flap extending from and hingedly connected to one of said top edges of said end wall panels or said top wall panels, said wall flaps being folded downwardly into close parallel and confronting contact with the corresponding side or end wall panel from which said wall flaps extends and fastened thereto, said retaining rim member being received between each of said wall flaps and the corresponding end or side wall panel to substantially enclose and attach the retaining rim member to the tote container.

13. The tote container of claim 12 wherein each wall flap further defines a second handgrip opening, each said second handgrip opening being aligned with and communicating with the first handgrip opening defined by the corresponding side or end wall panel to which the wall flap is fastened, such that each segment of the retaining rim member exposed through and by the first handgrip openings is exposed through and by the second handgrip openings.

* * * * *